United States Patent [19]

Kirschenbaum

[11] Patent Number: 4,487,464

[45] Date of Patent: Dec. 11, 1984

[54] ELECTRICAL SOCKET CONNECTOR CONSTRUCTION

[75] Inventor: Bernard Kirschenbaum, Denver, Colo.

[73] Assignee: AT&T Bell Laboratories, Murray Hill, N.J.

[21] Appl. No.: 415,024

[22] Filed: Sep. 7, 1982

[51] Int. Cl.[3] ..... H01R 31/08

[52] U.S. Cl. ..... 339/19; 339/176 MP

[58] Field of Search ..... 339/19, 176 MP, 222

[56] References Cited

U.S. PATENT DOCUMENTS 2,717,985 9/1955 Zellner ..... 339/19

2,927,296 3/1960 Boss et al. ..... 339/176 MP

*Primary Examiner*—John McQuade

*Assistant Examiner*—Steven C. Bishop

*Attorney, Agent, or Firm*—W. Ulrich; P. Visserman

[57] ABSTRACT

A socket connector (10) for printed wiring boards (37) in which signal or voltage connections may be made between the connector pins (14, 15) rather than by wiring printed on the board. A typical connector (10) is formed to present two lengthwise slots (19, 20) in either side wall (21, 22) of the connector housing (11) to provide access to the connector pins (14, 15). Electrically conductive strips (23, 30, 33, 40, 43) having bifurcated tabs (26, 27, 31, 32, etc.) extending therefrom are fitted into the housing slots (19, 20), the tabs clasping the selected pins (14, 15) to make the electrical connections required. The four slots and the underside of the connector housing make possible a number of pin interconnection combinations. Surface areas of the board are thus freed for other circuit purposes.

7 Claims, 2 Drawing Figures

ELECTRICAL SOCKET CONNECTOR CONSTRUCTION

TECHNICAL FIELD

This invention relates to electrical connector arrangements and particularly to such arrangements for providing intermediary socket connections between a printed wiring board and circuit packs and the like.

BACKGROUND OF THE INVENTION

Conventionally, electrical circuit components such as circuit boards, circuit modules, and the like are electrically interconnected to printed wiring boards by means of intermediary socket connectors. The connector may be of the zero insertion force type or it may have internal electrical contacts between which the surface contacts of a circuit board, say, are frictionally inserted. The internal contacts of the connector terminate in pins extending therefrom, which pins are fitted in plated-through apertures of a printed wiring board and are there typically soldered in place. The plated-through apertures terminate wiring printed on the board, which wiring conventionally completes electrical circuits between other connectors or components mounted on the board including circuits between the pins of individual connectors. Since the surface area of a printed wiring board is necessarily limited, the amount of wiring which may be practicably printed on the board is manifestly also limited. A reduction in the dimensions of the socket connector to make available greater board area for printed wiring is not feasible in view of the generally standardized dimensions of the circuit components received by the connector. Factors such as the inductance and capacitance between the wiring as well as the achievement of resolution and registration during the printing process also limit the reduction of the dimensions and spacing of the printed wiring itself as a means for achieving greater wiring density. It is accordingly the problem of increasing the usable wiring area of a printed wiring board to which the present invention is chiefly directed.

SUMMARY OF THE INVENTION

The objectives of the invention are realized in one illustrative circuit component socket connector construction in which electrical connections between terminal pins are selectively made within the connector itself rather than by wiring printed on the board on which it is mounted. The socket connector is conventionally provided with two rows of internal contacts adapted to frictionally electrically engage the edge contacts of a circuit board, for example, when the latter is inserted therebetween. The connector contacts conventionally extend through the connector to present two rows of pins arranged for fitting in corresponding plated-through apertures of a printed wiring board. The connector is formed to present two substantially parallel, lengthwise slots in each of its side-walls to expose the two rows of terminal pins within the connector. With access to the pins thus available, interconnections therebetween are made according to the principles of the invention, by means of electrically conductive strips having bifurcated tabs laterally extending therefrom. The tabs, spaced to correspond to the spacings of the pins to be connected, are formed to frictionally clasp the pins within their bifurcations when two or more tabs are fitted within a connector slot. Advantageously, the conductive strips may be formed in stock lengths and uniformly scored to permit the selective break-away of the bifurcated tabs and the strip itself.

BRIEF DESCRIPTION OF THE DRAWING

The organization of an electrical socket connector construction according to the principles of the invention together with its features will be better understood from a consideration of the detailed description of one illustrative embodiment thereof which follows when taken in conjunction with the accompanying drawing in which.

DETAILED DESCRIPTION

Figure 1:
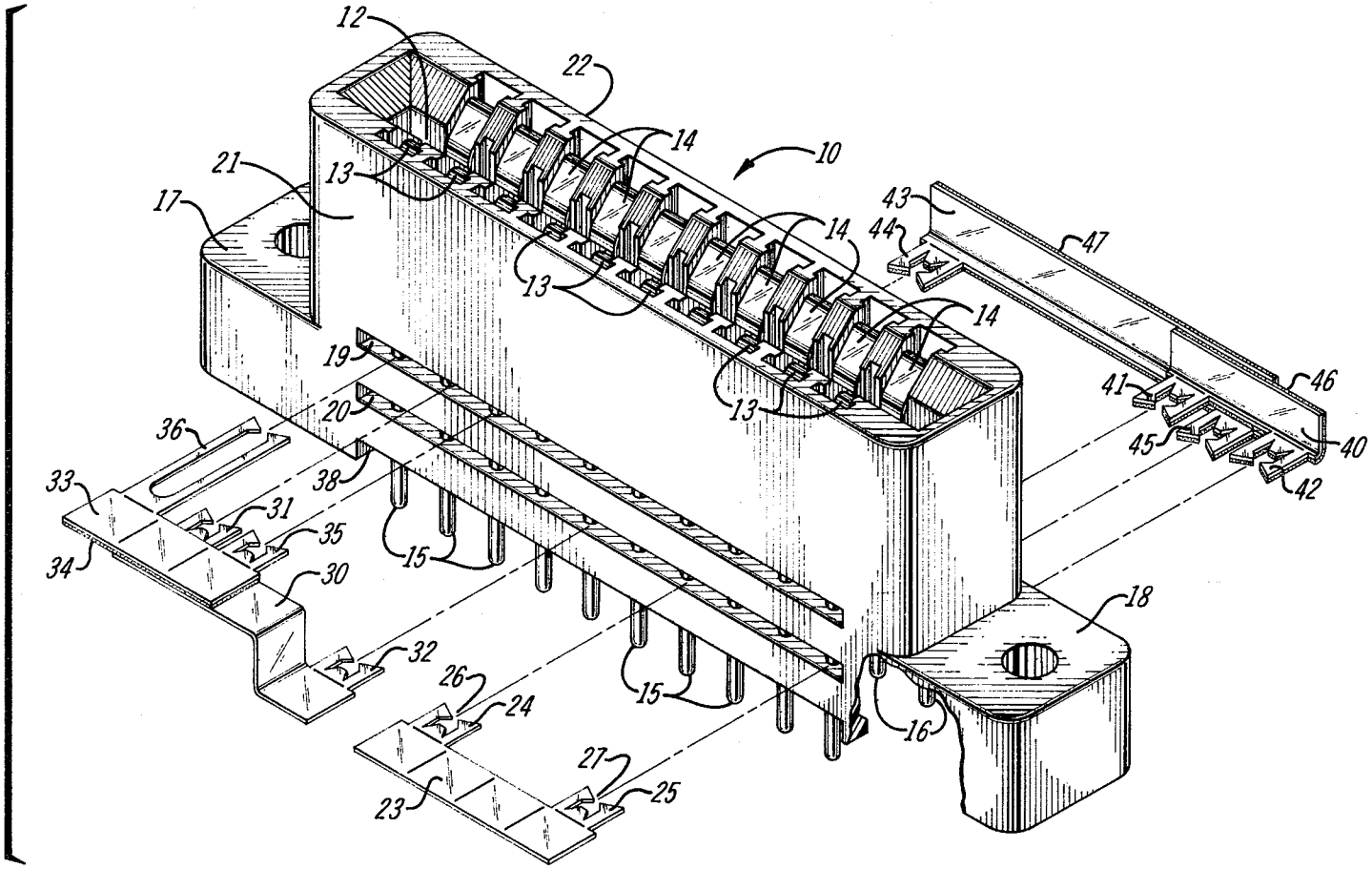
FIG. 1 is a perspective view of an illustrative socket connector construction according to the invention showing various examples of pin interconnecting strip means employable therewith, the housing being partially broken away better to show its details.

A socket connector construction 10 incorporating the features of the invention is shown in FIG. 1 and comprises an insulative housing 11 generally rectangular in form and having a lengthwise cavity 12 opening at its top, as viewed in the drawing, for receiving an electrical circuit board not shown. Oppositely arranged on opposite inner walls of cavity 12 are a first and a second plurality of electrical spring contacts 13 and 14 of a character well known in the art. Contacts 13 and 14 present flat contacting surfaces adapted to make electrical engagement with corresponding contact pads arranged along an edge on both sides of a circuit board when the latter is fitted into cavity 12. Conventionally, contacts 13 and 14 terminate in pins 15 and 16 which extend from the underside of housing 11. (See also FIG. 2). Pins 15 and 16, which may be of any convenient cross-section such as circular, are adapted to be fitted into corresponding plated-through holes of a printed wiring board not shown where they may be secured in place such as by soldering as is also known. A pair of drilled lugs 17 and 18 integrally formed at each end of housing 11 are provided for mounting housing 11 to a printed wiring board.

The plated-through holes of a printed wiring board are electrically connected in the circuits completed by the printed wiring of the board including, in the past, circuits which interconnected connector pins on which equal voltages or the same signals appear. Printed wiring for the latter interconnections thus occupies board area which is at a premium and which could be more economically used for printed wiring for completing the primary functional circuits of the board. In accordance with one feature of a connector construction according to the invention the aforementioned board area is freed for other printed wiring by making pin interconnections directly in conjunction with the connector housing itself. For this purpose, access to the pins 15 and 16 is achieved by two parallel slots 19 and 20 formed through both opposite outer walls 21 and 22, respectively, of housing 11. Various selected pin interconnections are thus made possible by means of electrically conductive strips having bifurcated tabs adapted to clasp the pins. One such strip 23 has a pair of tabs 24 and 25 extending therefrom spaced apart to correspond to the spacing of the two pins of pins 15 between which an electrical connection is to be made. Tabs 24 and 25, shown in alignment with lower slot 20 preparatory to their fitting therein, are bifurcated to present slots 26 and 27 dimensioned to clasp the selected ones of pins 15 as the tabs are so fitted. The openings of slots 26 and 27 are flared to facilitate entry of the pins.

Another example of the manner in which pin interconnections may be made in accordance with the invention is also shown in FIG. 1 which employs both slots 19 and 20 on one side of housing 11. A first conductive strip 30 has extending therefrom at each end a tab 31 and a tab 32 identical to the tabs described in the foregoing. The tabs are again spaced to correspond to the spacing of the pins 15 which are to be interconnected. In this case, strip 30 is bent to offset tab 32 from tab 31 by a distance equal to the distance between slots 19 and 20 so that tab 31 clasps its pin 15 through slot 19 and tab 32 through slot 20. (See also FIG. 2). Strip 30 may be advantageously combined with a second conductive strip 33 by means of any suitble adhesive, the strips being electrically separated by an insulative layer 34. Strip 33 has extending therefrom at one end a bifurcated tab 35 of the character already described adapted to clasp a pin 15 through upper slot 19. At its other end, strip 33 is provided with a tab 36 which is a variation of the tabs described hereinbefore. Tab 36 and its bifurcation is lengthened to make electrical contact with a pin 15 through slot 19 and with a pin 16, not shown, directly opposite on the other side of housing 11. It will be appreciated that, at the latter side of housing 11, similar and other connections may be made between pins 15 and 16 through slots 19 and 20 in accordance with the invention by interconnecting strips and tabs such as have been described.

Figure 2:
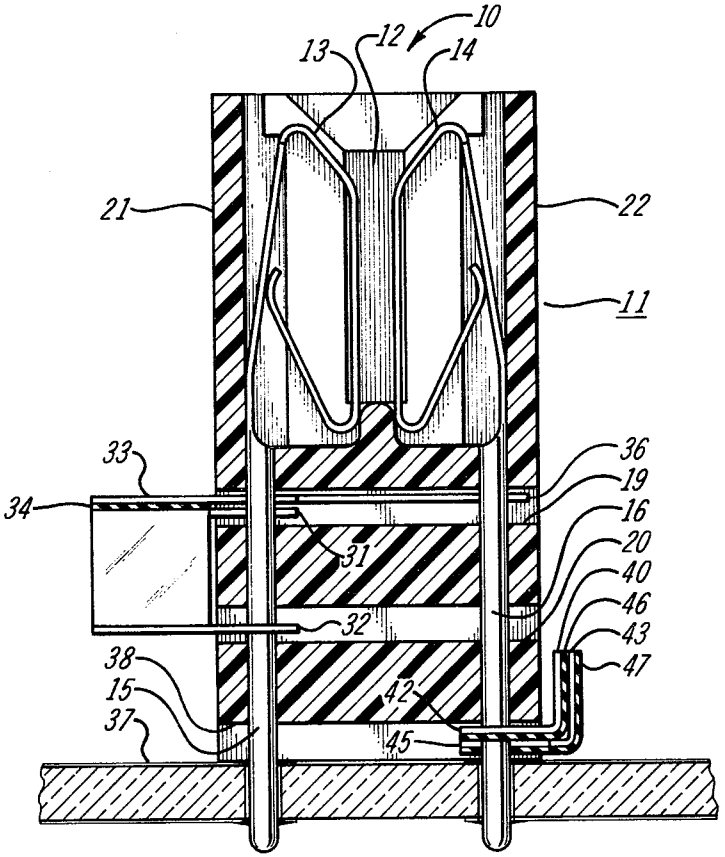
FIG. 2 is an enlarged cross-sectional view of the connector construction of FIG. 1 showing examples of pin interconnections in accordance with the invention, the connector being shown mounted on a partial section of a printed wiring board.

At the other side of housing 11 still another exemplary interconnection arrangement according to the invention is shown in alignment preparatory to its connection with pins 15 and 16. This arrangement is adapted to be fitted to selected ones of the latter pins on the underside of housing 11 between the latter and a printed wiring board 37 within a recess 38 formed in the underside of housing 11. (See FIG. 2). A first conductive strip 40 has extending therefrom and at right angles thereto at each end a bifurcated tab 41 and a tab 42 of the character already described. In this exemplary arrangement, strip 40 is combined with a second conductive strip 43 also having extending therefrom at right angles thereto at each end a bifurcated tab 44 and a tab 45 also of the character already described. Strips 40 and 43 are electrically insulated from each other by an insulative strip 46 and bonded together by means of any suitable adhesive. Strip 40 is insulated from the board wiring by a second insulation strip 47 bonded thereto. Advantageously, the turned-up arrangement of strips 40 and 43 makes available the interconnection feature of the invention even when a dense packing of socket connectors on a printed wiring board leaves no room for the extension of conductor strips, such as strips 33 and 30, outwardly from the connector housing 11 as shown in FIG. 2.

In each of the interconnection arrangements described in the foregoing, the conductive strips together with bifurcated tabs may be prepared in stock lengths and spacings. With suitable scoring the strips and tabs may thus be broken off or bent in the configurations as needed for particular pin interconnections. It will be appreciated that many other pin interconnection arrangements than the ones described in the foregoing are possible. Accordingly, the ones described are to be considered as exemplary only and not limiting of the invention which is limited only as defined in the accompanying claims.

What is claimed is:

1. An electrical socket connector construction comprising an insulative housing having a cavity for receiving an electrical component, an array of electrical contacts arranged in said cavity for engaging corresponding contacts on said component, said array of electrical contacts terminating respectively in an array of pins extending through said housing, said housing having a slot for obtaining access to said array of pins, and an electrically conductive strip having bifurcated tabs extending therefrom spaced to engage predetermined ones of said pins through said slot.

2. An electrical socket connector construction comprising an insulative housing having an array of electrical contacts for engaging corresponding contacts of an electrical component, said array of electrical contacts terminating respectively in an array of pins extending through the underside of said housing, and an electrically conductive strip having bifurcated tabs extending therefrom adapted to engage predetermined ones of said pins, said housing being formed to permit access to said last-mentioned pins by said tabs.

3. An electrical socket connector construction as claimed in claim 2 in which said housing is formed to provide a slot in a housing wall to permit access to said last-mentioned pins by said tabs.

4. An electrical socket connector construction as claimed in claim 3 in which said housing is also formed to present a recess in said underside to permit access to said last-mentioned pins by said tabs.

5. An electrical socket connector construction comprising an insulative housing having a pair of opposing side-walls and a cavity substantially parallel to said side-walls for receiving an electrical circuit board, a first and a second array of electrical contacts arranged in said cavity along said pair of side-walls respectively for engaging corresponding contacts of said circuit board, the contacts of each of said arrays terminating respectively in a first and second array of terminal pins extending through the underside of said housing, said housing having at least one slot in each of said side-walls for obtaining internal access to each of said arrays of terminal pins, and at least one first electrically conductive strip having at least two bifurcated tabs extending therefrom spaced to engage predetermined pins of said arrays of pins through said slots in said housing side-walls.

6. An electrical socket connector construction as claimed in claim 5 also comprising at least one second electrically conductive strip having at least two bifurcated tabs extending therefrom spaced to engage predetermined pins of said arrays of pins on the underside of said housing, said second strip being turned up at substantially 90 degrees to present a flange abutting one of said side-walls.

7. An electrical socket connector construction comprising an insulative housing having a pair of opposing side-walls and a cavity between said side-walls for receiving an electrical circuit board, a first and a second array of electrical contacts arranged in said cavity along said pair of side-walls respectively for engaging corresponding contacts of said circuit board, the contacts of each of said arrays terminating respectively in a first and second array of opposing terminal pins extending through the underside of said housing, said housing having a slot in at least one of said side-walls for obtaining internal access to said arrays of terminal pins, and an electrically conductive strip having a first bifurcated tab extending therefrom for engaging a first predetermined pin of one of said arrays of pins through said slot and a second bifurcated tab extending therefrom for engaging a second predetermined pin of said one of said arrays of pins and a pin opposing said last-mentioned pin in the other of said arrays of pins through said slot.

* * * * *